United States Patent [19]

Jones

[11] Patent Number: 5,044,632

[45] Date of Patent: Sep. 3, 1991

[54] DUMBBELL PRESS EXERCISE MACHINE

[75] Inventor: Gary A. Jones, Falmouth, Ky.

[73] Assignee: Hammer Corporation

[21] Appl. No.: 514,839

[22] Filed: Apr. 26, 1990

[51] Int. Cl.[5] ..... A63B 21/00; A63B 21/22

[52] U.S. Cl. ..... 272/134; 272/132; 272/144; 128/25 R

[58] Field of Search ..... 272/118, 134, 71, 73, 272/141, DIG. 4, 116, 117

[56] References Cited

U.S. PATENT DOCUMENTS 3,858,873 1/1975 Jones .
3,998,454 12/1976 Jones .
4,720,099 1/1988 Calson ..... 272/134

OTHER PUBLICATIONS

Brochure Entitled "Nautilus Midwest".

*Primary Examiner*—Richard J. Apley

*Assistant Examiner*—Jerome W. Donnelly

*Attorney, Agent, or Firm*—Wood, Herron & Evans

[57] ABSTRACT

An improved exercise machine for performing a dumbbell press includes a frame, a seat connected to the frame and two independently maneuverable levers with rearward ends that are pivotally connected to the frame behind and above the seat. The forward ends of the levers are adapted to hold removable weights and also include forwardly and upwardly angled handles adapted to be grasped and pressed in an upward arcuate direction by a person supported on the seat. The orientation of the sides of the frames and the levers with respect to the seat insures that pivotal movement of the levers occurs along vertical planes that diverge outwardly from the front of the seat, thereby providing a dumbbell press exercise machine that more naturally accommodates the musculoskeletal movements of a person.

17 Claims, 4 Drawing Sheets

DUMBBELL PRESS EXERCISE MACHINE

FIELD OF THE INVENTION

This invention relates to an improved dumbbell press exercise machine that accommodates the natural musculoskeletal makeup of a person.

BACKGROUND OF THE INVENTION

Many athletes and non-athletes utilize weight lifting or weight training exercises to build strength and/or bulk, to prevent injury, or to improve overall condition and appearance. Typically, weight training exercises are performed with either exercise machines or free weights, i.e., barbells and weighted plates, dumbbells, etc. For various reasons, most exercise programs incorporate both machines and free weights in a variety of different exercise routines in order to maximize the effect of working out a desired number of muscle groups.

On one hand, free weights offer a number of advantages over exercise machines. For one, they are relatively inexpensive in comparison. Free weights are also more versatile because a variety of exercises can be performed with one set of weights, whereas most exercise machines are designed for only one exercise. For those exercise machines which provide for more than one exercise, cost usually increases proportionately with the number of exercises. Finally, free weights are popular among many weight lifters because the lifting movements are not restricted to prescribed planes of motion and at prescribed angles.

However, there are a number of inherent disadvantages associated with free weights. One such disadvantage relates to safety. Although most weight room instructors strongly advise against an individual working out by himself or herself, this cautionary measure is particularly important when the lifting of free weights is involved. This is due to commonly recognized dangers such as the possibility of dropping a weight on a body part, or becoming trapped beneath a bar, which could easily occur in exercises such as bench press, incline press or squat. Additionally, through carelessness, loading and unloading of heavy weighted plates onto the ends of a bar sometimes results in an unbalanced bar that falls downward from its rack.

Another disadvantage associated with free weights relates to the fact that the weight resistance, or opposing force, that is exercised against is always directed vertically downward by gravity. Yet, the moment arm of the weight about the pivot point varies considerably throughout the full range of motion. This principle is explained in U.S. Pat. No. 3,998,454 with respect to a commonly performed exercise referred to as the dumbbell bicep curl. In short, the applied moment arm about the elbow varies according to the sine of the angle of the lower arm with respect to the vertically oriented upper arm. The moment arm is greatest when the angle is 90°, and it is lowest near 180° and 0°.

If the resistance capabilities of the muscles of the human body matched this moment arm, the degree of difficulty experienced by the exerciser would be uniform, or balanced, throughout this range of motion. However, as reported in U.S. Pat. No. 3,998,454, the strength generated by the human muscles during this exercise is not in fact "balanced" throughout the range of motion, and there are some "sticking points" of increased difficulty. As a result, maximum benefits are not achieved when performing a bicep curl with a dumbbell.

A pullover machine disclosed in U.S. Pat. No. 3,998,454 utilizes an eccentric cam to vary weight resistance over the range of motion for the muscles utilized in a pullover maneuver. Over the years, for various muscle groups, a number of these cam and chain machines have attempted to match resistance variation through a range of motion with the natural strength curve associated with the human body for those particular muscle groups. To the extent that these machines actually do correctly match resistance variation to the appropriate strength curve, an improvement over lifting of free weights has been achieved.

However, machines of this type suffer from a number of practical disadvantages. For instance, the chains and cams of these machines are susceptible to rust and debris buildup which increases the total amount of resistance against movement of the limb during exercise. Moreover, some of the cam and chain machines employ resistance in the form of permanently connected weight plates that move along a rigid guide. This guide is also susceptible to rust or debris buildup. In order to maintain optimum conditions for these machines, the chains, cams and guides must be lubricated regularly.

In addition to the practical disadvantages associated with maintenance and/or maintenance costs, another disadvantage relates to the fact that these cam and chain machines do not permit the degree of freedom of movement that is possible when lifting free weights. For example, with respect to a muscle group other than the one to which this invention is directed, the pullover machine of U.S. Pat. No. 3,998,454 restricts upper body movement along two parallel, rigidly connected planes, with shoulder pivot about vertically fixed positions. Many exercisers complain that this machine or others like it are simply too confining with respect to the possible freedom of movement for the muscles that are exercised, confining almost to the point of discomfort.

One attempt to solve this problem involves the use of machines that employ weighted levers. With respect to an exercise commonly referred to as a dumbbell press, because it is most often performed with dumbbells, a machine has been designed that utilizes a double handled lever pivotally connected to a frame to effectively work the same muscle group used when performing a seated press with dumbbells. In relation to the respective muscle groups, lever-type machines of this nature permit more degrees of freedom of movement than cam and chain machines such as the pullover machine disclosed in U.S. Pat. No. 3,998,454.

Unfortunately, even this lever-type machine suffers from a subtle disadvantage that most weight lifters apparently have assumed to be inherent with all exercise machines. That is, the planes or angles of prescribed movement do not seem quite right in relation to the musculoskeletal structure of a normal person. In short, this machine and others like it do not seem to "fit" the human body, or simply, they do not feel right. Moreover, some individuals have complained that excessive joint stress may result from use of these machines.

One explanation for this problem is derived from a theory that is based upon accumulated years of observing and analyzing athletic movements of the body in comparison to weight lifting movements. Proponents of this theory point out that most musculoskeletal movements are rather complex and involve multiple joints and multiple degrees of freedom, while most exercise machines are designed to mimic simple movements that are at either right angles or parallel to the body. In a sense, most exercise machines oversimplify the musculoskeletal movements of the human body, and there is room for improvement in the design of exercise machines, particularly when considering that the ultimate objective is to obtain maximum muscular benefit with minimum joint stress.

Finally, although the prior dumbbell press machine known by the inventor may be used to exercise one arm at a time, it was not designed specifically for that purpose. As a result, performance of onehanded exercise on such a machine may even further accentuate the awkwardness that is felt. This significantly limits the practical uses of such machines for the purpose of rehabilitation, where it is often desirable to monitor the relative strength of a previously injured, recovering limb in comparison with a healthy limb.

It is therefore an object of the invention to provide an improved dumbbell press exercise machine that more naturally accommodates the musculoskeletal movements of a person's body.

It is another object of the invention to provide an improved dumbbell press exercise machine that maximizes the exercise benefit attainable during a military press maneuver while minimizing skeletal or joint stress associated therewith.

It is still another object of the invention to provide an improved dumbbell press exercise machine with increased versatility in exercising one arm at a time.

SUMMARY OF THE INVENTION

This invention contemplates a dumbbell press exercise machine having a frame that pivotally supports the rearward ends of two levers, with forward ends that are adapted to be grasped and moved upwardly in arcuate paths via a typical dumbbell press maneuver, either independently or simultaneously, against weighted plates removably supported at the forward ends, with the exercise motions oriented in a manner that accommodates the natural musculoskeletal structure of the human body.

The frame has sides that diverge outwardly from the front of the machine, and the levers are moved through correspondingly diverging planes. Moreover, the locations of the non-aligned pivot axes, the lengths and starting angles of the forward ends of the levers, and the angles of the handles attached to the forward ends combine to provide a machine that, based upon feedback from a number of individuals involved in the field of strength training, more naturally accommodates the musculoskeletal movements of a human being during a dumbbell press.

By providing two independently operable levers, each designed to match the natural movement of muscles of one side with respect to the entire body, this improved dumbbell press machine is particularly suitable for rehabilitation after an injury.

In accordance with the objects of this invention, a dumbbell press exercise machine preferably includes a frame, a seat connected to the frame, the frame having two vertically upright sides that diverge outwardly from the front of the seat and two levers, each lever pivotally connected at a rearward end to one of the outwardly diverging sides and having a forward end in front of the seat with an angled handle connected thereto and a weight supporting hub for holding weighted plates. The pivot axes of the levers are both located above and behind the seat and are perpendicular to their respective sides of the frame. When the handles are grasped and pressed upwardly in a manner referred to as a dumbbell press, the arcuate paths traversed by the handles and the levers are along vertical planes that diverge outwardly from a vertical midplane that bisects the seat. The angled orientation of the levers and the handles with respect to the forward facing direction of the seat provides a natural grasping position for coupling the applied pressing force to two diverging vertical planes of motion that seem to more naturally accommodate the structure of the human body relative to this maneuver. As a result, a person supported on the seat is able to maximize the muscular benefits attainable with a dumbbell press exercise. This invention exercises a muscle group that includes the triceps, the shoulder and the pectoral muscles, and it does so in a manner that does not stress joints associated with this muscle group.

As noted above, due to the more natural orientation of the sides of the frame with respect to a human body, and the capability of working both arms independently, the dumbbell press machine constitutes an improvement over prior lever-type press machines that applicant is aware of. This invention provides the benefits of both free weights and weight machines without the attendant disadvantages commonly associated with these methods of exercising.

For this machine, the resistance variation through the dumbbell press movement is similar to the resistance variation provided by the prior lever-type press machine. However, it is not identical. The initial angle and length of the forward ends of the lever arms and the location of the pivot axes with respect to the seat have been oriented to make it slightly easier to initiate the pressing motion, and slightly more difficult once the press has been initiated, and then easier again at the end of the motion. This compensates for the initial acceleration required to commence movement against the weight and the reduction in force caused by the momentum of a moving lever, and a terminal deceleration at the end of the movement.

These and other features of the invention will be more readily understood in view of the following detailed description and the drawings in which:

DETAILED DESCRIPTION OF THE DRAWINGS

Figure 1:
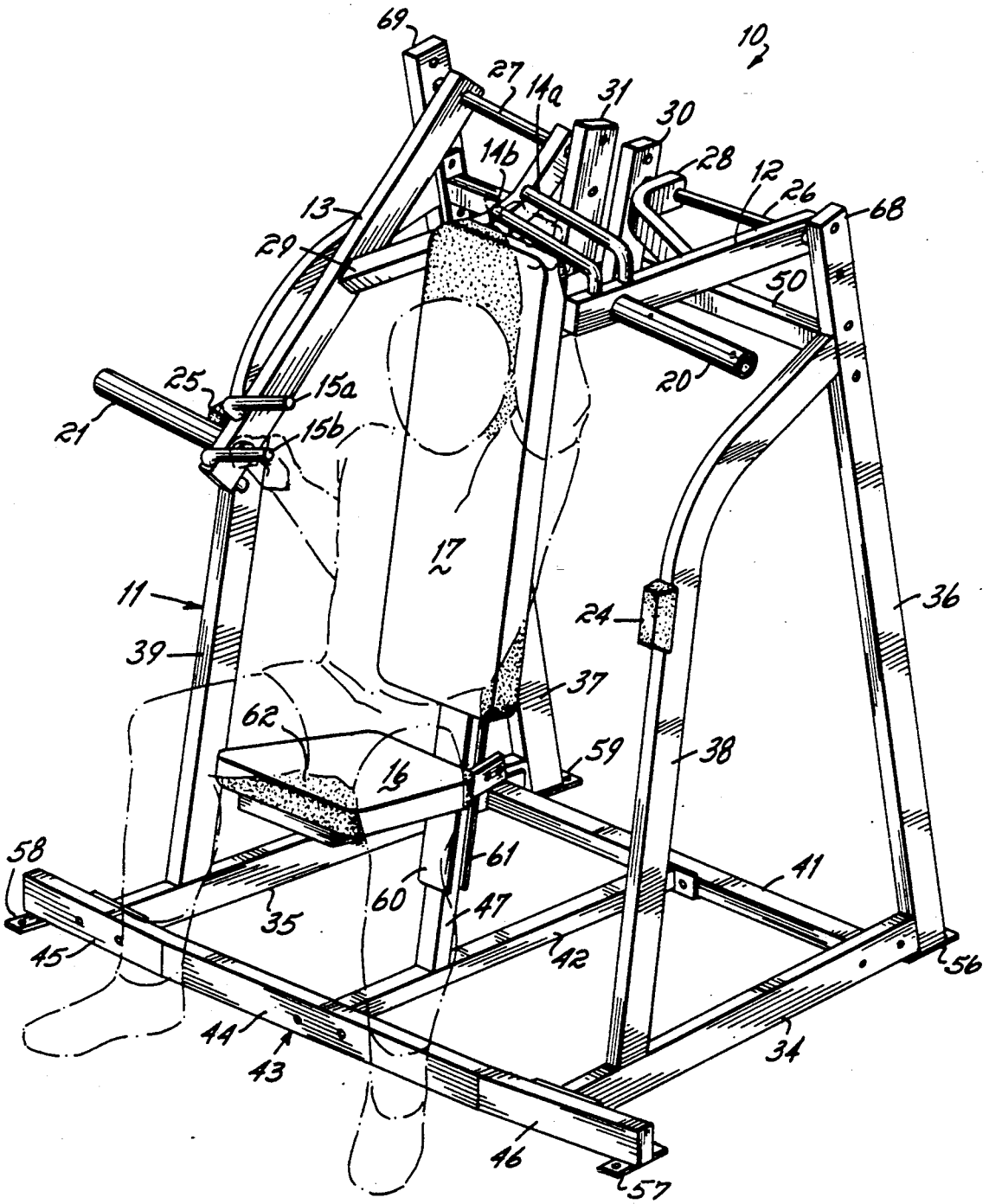
FIG. 1 is a perspective view of a dumbbell exercise machine in accordance with a preferred embodiment of the invention.

FIGS. 1–4 show a dumbbell press exercise machine 10 in accordance with a preferred embodiment of the invention. This machine 10 includes a frame 11 made of a number of straight and curved sections of heavy duty steel that are either welded or bolted together, or pivotally connected. Exercise levers 12 and 13 are pivotally connected to the frame 11 at their rearward ends. Handles 14*a* and 14*b*, and 15*a* and 15*b* are connected to the forward ends of levers 12 and 13, respectively. The handles are located above a seat 16 and a back support 17 The seat 16 and back support 17 are bisected by a vertical midplane 18 (shown in FIG. 2) that extends through the middle of frame 11. The machine 10 is symmetrical with respect to midplane 18. When supported on the seat 16, a person reaches up and grasps a set of handles, either 14*a* and 15*a*, or 14*b* and 15*b*. With a motion commonly referred to as a dumbbell press, either simultaneously with both arms or independently, in an asynchronous manner, the forward ends of the levers 12 and 13 may be pivoted upwardly in arcuate paths against the weight resistance of any weighted plates held by the hubs 20 and 21 that are also located at the forward ends of levers 12 and 13, respectively.

The frame 11 has two sides, each of which sides diverge outwardly from midplane 18 with respect to the forward direction of the machine 10, or to the direction that a person sitting on the seat 16 would face. Each side has a bottom support, a rear leg and a front leg. On the left side of the frame 11, as viewed by one seated on seat 16, these parts are numbered 34, 36 and 38, respectively. Similarly, on the right side of frame 11 these parts are numbered 35, 37 and 39, respectively. Front legs 38 and 39 bend rearwardly about ¾ of the way up. The metal sections forming the sides are preferably connected together by welds.

Figure 2:
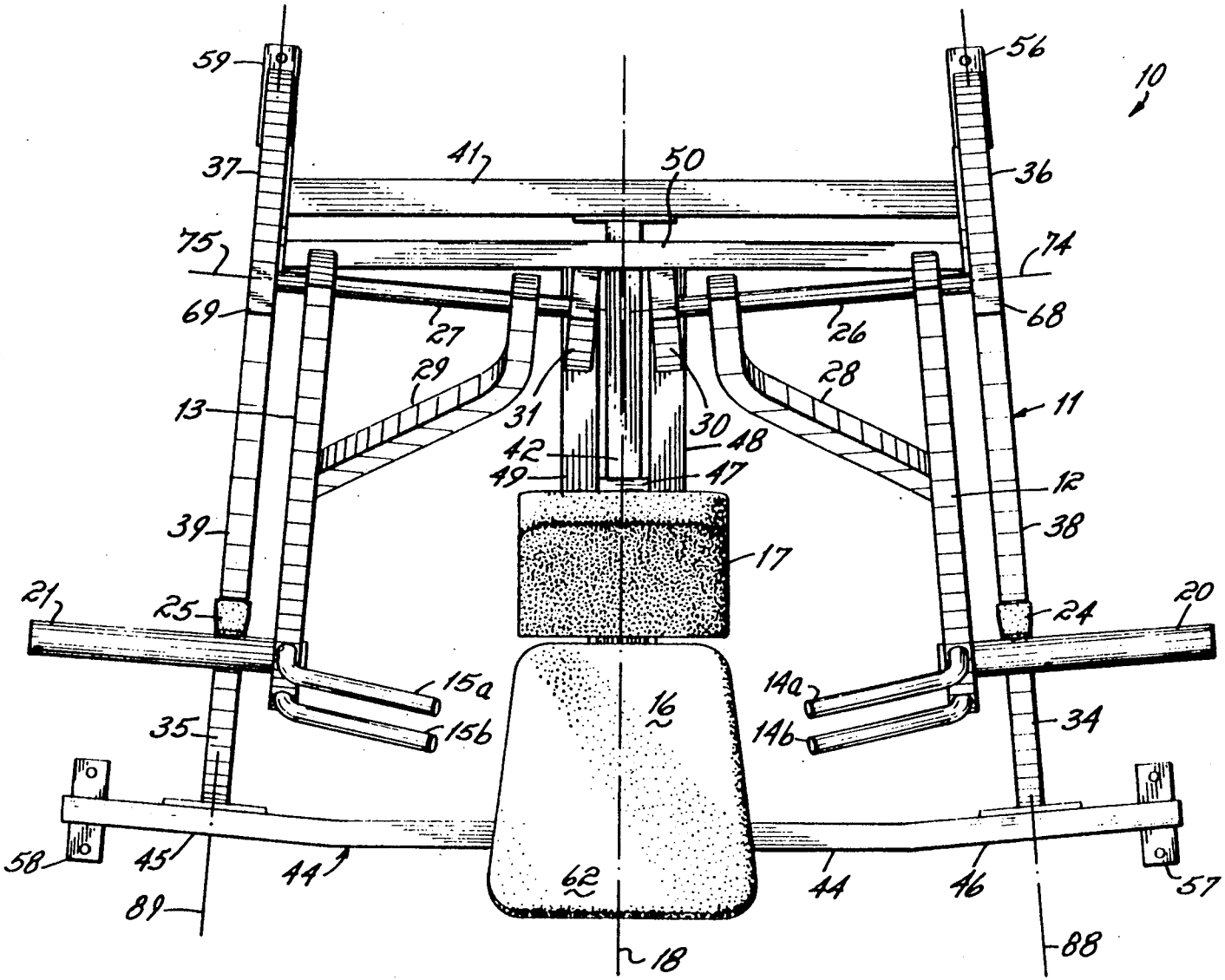
FIG. 2 is a top view of the dumbbell press exercise machine shown in FIG. 1.

At the bottom of the frame 11, the sides 34 and 35 are connected by a base which includes a rear section 41, a mid section 42 and a front section 43. Front section 43 includes a central portion 44 that is parallel with rear section 41, and outer portions 45 and 46 that angle rearwardly to connect to bottom supports 34 and 35, respectively. The bottom side supports 34 and 35 both diverge outwardly with respect to the front of the machine 10, preferably at angles of about 5° (FIG. 2). The forward ends of sections 34, 42 and 35 are connected to front section 43, preferably by bolts (not shown). The bolts pass through holes in end plates welded perpendicularly to the ends of the respective sections. Rear section 41 is also connected by bolts to the rear ends of bottom supports 34 and 35. The frame 11 may also include base supporting plates 56, 57, 58 and 59 which are welded to the bottom of frame 11 at the exterior four corners.

Seat 16 and back support 17 are connected to a central leg 47 that is aligned along vertical midplane 18. Central leg 47 is welded at its bottom end to middle section 42 and supported at its top end by braces 48 and 49 which in turn connect to transverse brace 50 (FIG. 2). While the back support 17 is rigidly fixed to central leg 47, seat 16 is preferably adjustable upwardly or downwardly. Adjustment is provided by frictional engagement between parallel spaced bars (not shown) connected to seat 16 and two planar pieces 60 and 61 that are secured to central leg 47 in a sandwiching arrangement. To raise or lower the seat 16, a forward end 62 of the seat is tilted upwardly with respect to central leg 47 so that the spaced parallel bars move away from, or provide clearance from pieces 60 and 61. In this orientation, the seat 16 may be moved upwardly or downwardly, parallel to leg 47. When the forward end 62 is subsequently tilted downwardly, the parallel bars of seat 16 will frictionally engage the pads. Any number of other methods for providing adjustability for seat 16 would be equally suitable.

Preferably, brace 50 is bolted at its spaced ends to upper, interior facing sides of the rear legs 36 and 37. Uprights 30 and 31 are welded to sections 48 and 49, respectively. These uprights 30 and 31 must be situated on sections 48 and 49, respectively, in such manner that accommodates the offset angle of the respective sides of the frame 11, this offset angle preferably being about 5°. Along with the uppermost ends, 68 and 69, of rear legs 36 and 37, respectively, uprights 30 and 31 dictate the axes for pivotal connection of levers 12 and 13, respectively.

Lever 12 includes an axle 26 aligned along an axis of connection 74, while lever 13 includes a axle 27 aligned along an axis of connection 75. These axes are shown in FIG. 2. The axles 26 and 27 are connected to frame 11 by bearings. A pillow block bearing sold by Browning, Part No. VF 2S 116 has proved suitable. These bearings require maintenance only once a year, which consists of one shot of lubricating oil. Both axis 74 and axis 75 are oriented perpendicular to their respective diverging exterior sides of the frame 11. Axes 74 and 75 are also both located behind and above seat 16. For additional strength and stability, levers 12 and 13 include stabilizing braces 28 and 29, respectively, connection with the axle near the uprights to the respective forward ends of the levers. The hub 20 of the forward end of lever 12 coacts with a rubber stop 24 mounted to leg 38 to limit downward pivotal movement. Similarly, the hub 21 at the forward end of lever 13 coact with rubber stop 25.

FIG. 2 shows, from a top view, levers 12 and 13, and their respective axes 74 and 75. This view clearly shows the divergence of the sides of frame from midplane 18, the sides being aligned along vertical planes 88 and 89. This view also shows angled side portions 45 and 46 bent rearwardly at angles of about 5° to accommodate the forward divergence of the sides of the frame 11. As shown in this view, brace 50 and rear section 41 are of shorter side to side length than front section 43, in order to accommodate this divergence of the sides of the frame 11.

By providing two sets of handles, 14*a* and 15*a*, and 14*b* and 15*b*, this dumbbell press exercise machine is versatile in accommodating individuals of different heights, or for accommodating some variation in the way that the dumbbell press muscle group is exercised. The angles of the handles couple natural grasping positions for the hands to the diverging planes, thereby enabling motive force to be applied through a dumbbell press in diverging planes that more naturally which extend from interior positions of connection with the axle near the uprights to the respective forward ends of the levers. The hub 20 of the forward end of lever 12 coacts with a rubber stop 24 mounted to leg 38 to limit downward pivotal movement. Similarly, the hub 21 at the forward end of lever 13 includes a rubber stop 25.

FIG. 2 shows, from a top view, levers 12 and 13, and their respective axes 74 and 75. This view clearly shows the divergence of the sides of frame from midplane 18, the sides being aligned along vertical planes 88 and 89. This view also shows angled side portions 46 and 47 bent rearwardly at angles of about 5° to accommodate the forward divergence of the sides of the frame 11. As shown in this view, brace 50 and rear section 41 are of shorter side to side length than front section 43, in order to accommodate this divergence of the sides of the frame 11.

By providing two sets of handles, 14*a* and 15*a*, and 14*b* and 15*b*, this dumbbell press exercise machine is versatile in accommodating individuals of different heights, or for sight variation in the way that the dumbbell press muscle group is exercised. The angles of the handles couple natural grasping positions for the hands to the diverging planes, thereby enabling motive force to be applied through a dumbbell press in diverging planes that more naturally accommodate the musculoskeletal structure of a human being. Compared to the prior lever-type press machine, where the planes of movement were parallel with respect to a central vertical plane, frame 11 enables a person to perform a dumbbell press exercise, either simultaneously with both arms or independently, in a manner which does not place unnecessary stress upon joints associated with this muscle group. This machine 10 not only accommodates a more natural orientation of the body, but also permits natural dumbbell press exercise of one arm at a time, a feature that is particularly desirable for rehabilitation.

Figure 3:
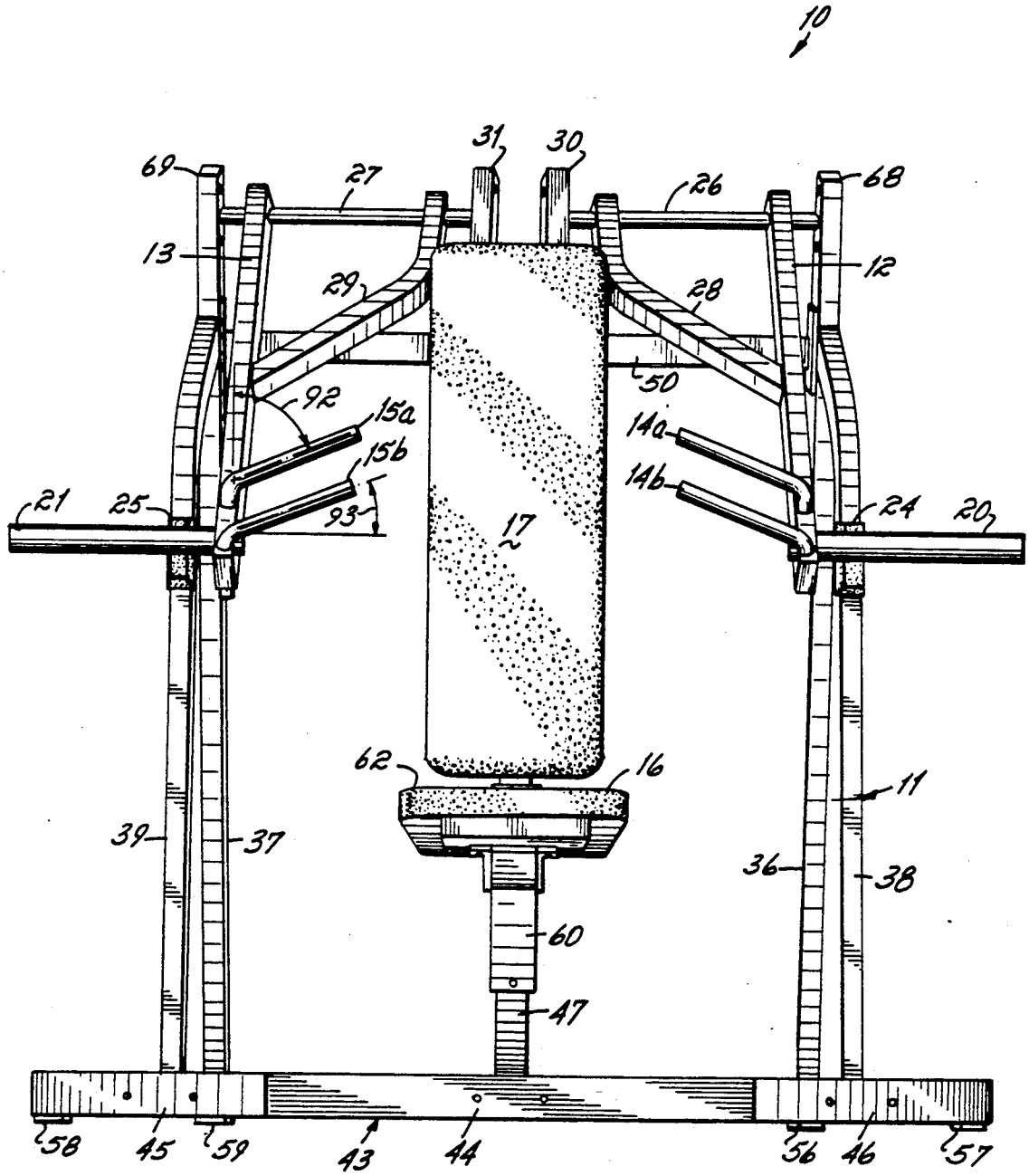
FIG. 3 is a front view of the dumbbell press exercise machine shown in FIG. 1.
Figure 4:
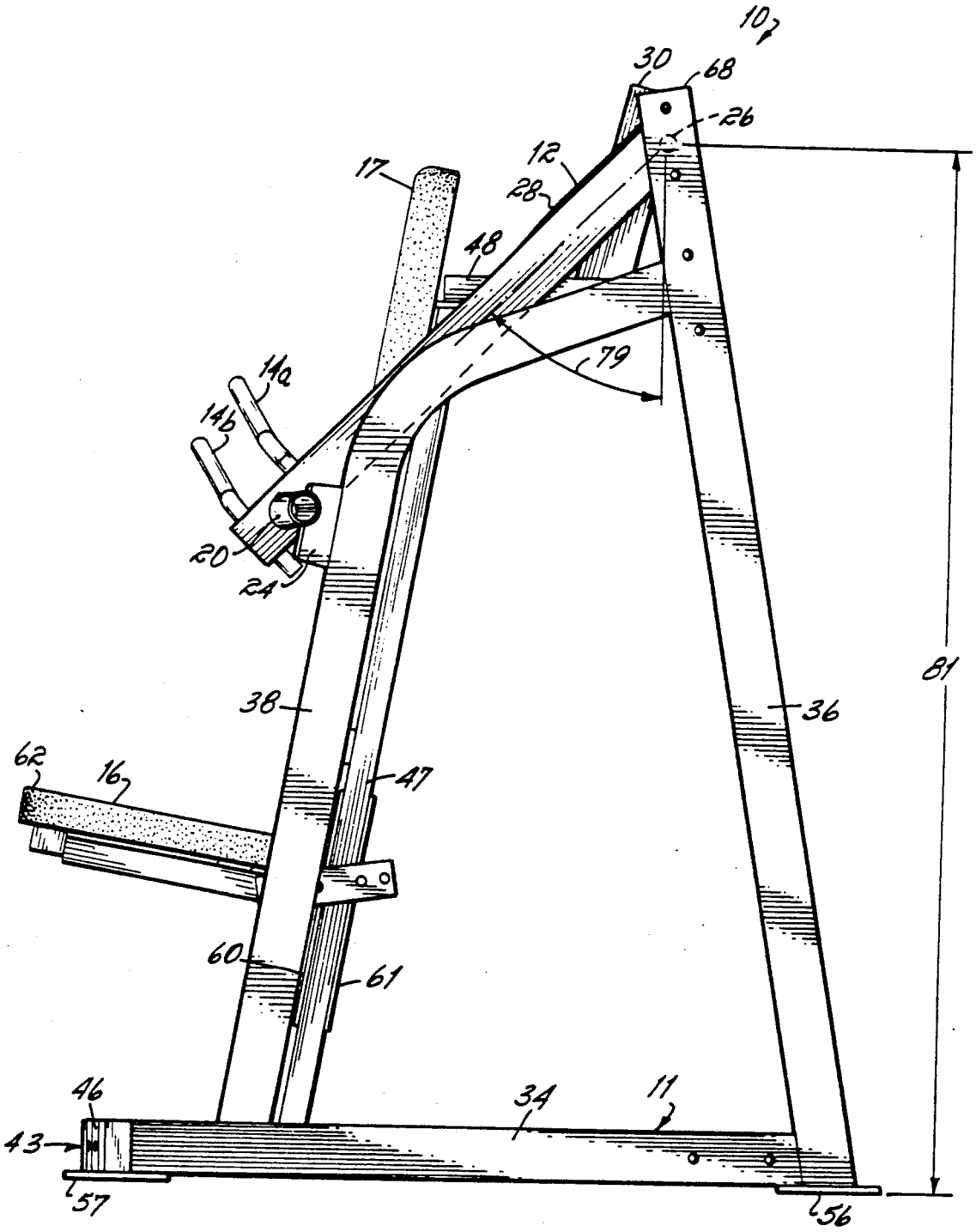
FIG. 4 is a side view of the dumbbell press exercise machine shown in FIG. 1.

FIG. 4 shows the distance that the pivot points are located above the vertical surface that supports the machine 10. This distance is designated by numeral 81 and is preferably about 51". FIG. 4 also shows that lever arm 12 is downwardly angled, at an angle offset from vertical by about 30°, an angle designated by numeral 79. The lever 12 is about 30" in length. The handles 14*a*, 14*b*, 15*a* and 15*b* are forwardly and upwardly angled with respect to the ends of the levers. The handles are almost perpendicular with the levers, but not quite, being oriented at a forward or inward angle of about 85°, an angle designated by numeral 92 (as shown in FIG. 3). The handles also angle upwardly from the respective levers, at an angle of about 20°, designated by numeral 93 (FIG. 3).

While I have described a preferred embodiment of this invention, it is to be understood that the invention is not limited thereby and that in light of the present disclosure of the invention, various other alternative embodiments will be apparent to a person skilled in the art. For instance, the structural orientation of some parts of the frame 11 is not critical, so long as the positioning of the seat 16 and support 17 with respect to the location of the pivot points and the lever arm lengths and angles is maintained. Additionally, while the particular angles shown are considered to be optimum at this point in time, based upon feedback from those involved in strength training, it is entirely possible that some further refinements may evolve. Accordingly, it is to be understood that changes may be made without departing from the scope of the invention as particularly set forth and claimed.

I claim:

1. A dumbbell press exercise machine comprising:

a frame:

a seat connected to the frame and adapted to support a person in a seated position straddling a first vertical plane;

a lever pivotally connected at one of its two ends to the frame and adapted to be pivoted about an axis located behind and above said seat, the lever adapted to hold a removable weight at the other of its two ends;

at least one handle connected to said other end of the lever and adapted to be grasped and pressed in an upward arcuate direction by a person supported on said seat, the upward arcuate movement causing said lever to be pivoted in an outer vertical plane that diverges from said first vertical plane.

2. The dumbbell press exercise machine of claim 1 and further comprising:

a second lever pivotally connected to the frame, the second lever being a mirror image of the first lever with respect to the first vertical plane and having a handle adapted to be grasped and pressed in an upward arcuate direction along a second outer vertical plane that also diverges from said first vertical plane.

3. The dumbbell press exercise machine of claim 1 wherein said handle extends from said other end in an upwardly and forwardly directed angle.

4. The dumbbell press exercise machine of claim 1 and further comprising:

stop means connected to said frame to coact with said other end of said lever to limit pivotal movement of the lever with respect to the frame.

5. The dumbbell press exercise machine of claim 1 wherein said outer vertical plane diverges from said central vertical plane at an angle of about 5°.

6. The dumbbell press exercise machine of claim 5 wherein said a starting position of lever is angled downward from the horizontal at an angle of about 60°.

7. The dumbbell press exercise machine of claim 6 wherein said handle angles inwardly from said lever at an angle of about 85°.

8. The dumbbell press exercise machine of claim 7 wherein said handle extends upwardly from said lever at an angle of about 20°.

9. The dumbbell press exercise machine of claim 1 and further comprising a second handle connected to the forward end of the lever, the second handle being parallel with the first handle.

10. A dumbbell press exercise machine comprising:

a frame having two upright vertical sides that are mirror images of each other with respect to a central vertical plane, the sides aligned along outer vertical planes that both diverge from the central vertical plane with respect to a front of the frame;

a seat connected to the frame and adapted to support a person in a seated position straddling the central vertical plane;

two levers, each lever pivotally connected to a side of the frame at a rearward end thereof and pivotal about an axis perpendicular to the outer vertical plane occupied by the respective side, each lever having a forward end adapted to hold a removable weight; and two handles, each handle connected to the forward end of a lever and adapted to be grasped and pressed in an upward arcuate direction by a person supported in the seat to pivot the lever along the respective outer vertical plane against a predetermined weight resistance supported at said forward end, thereby to provide simultaneous and/or independent press exercise along said diverging planes.

11. The dumbbell press exercise machine of claim 10 and further comprising:

two additional handles, each handle being connected to a forward end of one of the levers and being parallel to a first handle connected thereto.

12. The dumbbell press exercise machine of claim 10 wherein the axes of pivotal motion of the levers are each located above and behind the seat.

13. The dumbbell press exercise machine of claim 10 wherein each said handle is angled upwardly and forwardly with respect to the respective lever.

14. The dumbbell press exercise machine of claim 10 wherein each outer vertical plane is oriented outwardly at an angle of about 5° with respect to the central vertical plane.

15. The dumbbell press exercise machine of claim 10 wherein the frame further comprises:

a pair of stop means, each stop means connected to a side of the frame and adapted to coact with the respective lever to limit downward pivotal motion of a forward end of said lever.

16. A dumbbell press exercise machine comprising:

a frame having a front and two sides that lie in planes which diverge outwardly from the front;

a seat connected to the frame and facing the front of the frame; and dumbbell press exercise means pivotally connected to each of the sides, each press exercise means adapted to provide exercise via a pressing motion against a selectable weight resistance and in an arcuate path along a plane parallel to the respective side for a person supported on the seat.

17. The exercise machine of claim 16 wherein each said side diverges from said mid-plane at an angle of about 5°.

* * * * *